US006250032B1

(12) United States Patent
Davis et al.

(10) Patent No.: US 6,250,032 B1
(45) Date of Patent: Jun. 26, 2001

(54) CONNECTOR ARRANGEMENT FOR ADJACENT PANELS

(75) Inventors: Deborah Davis, Grand Haven; Bryan R. Gingrich; Gerald Hunsburger, both of Holland, all of MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/325,905

(22) Filed: Jun. 4, 1999

(51) Int. Cl.[7] ..... E04B 2/74

(52) U.S. Cl. ..... 52/239; 52/36.1; 52/36.6; 52/127.1; 52/285.1; 52/584.1

(58) Field of Search ..... 52/36.1, 36.6, 52/127.1, 239, 285.1, 584.1

(56) References Cited

U.S. PATENT DOCUMENTS 5,062,246 11/1991 Sykes .
5,134,826 8/1992 La Roche et al. .
5,377,466 1/1995 Insalaco et al. .
5,406,760 4/1995 Edwards .
5,642,593 7/1997 Shieh .

OTHER PUBLICATIONS

Photo of Vizion Corner Connector with cover (1 sheet).
Photo of Vizion Corner Connector (1 sheet).

*Primary Examiner*—Christopher T. Kent
(74) *Attorney, Agent, or Firm*—Flynn, Thiel, Boutell & Tanis, P.C.

(57) ABSTRACT

A connector arrangement for use with an interior space-dividing wall system including portable upright panel assemblies each having an end edge defined by a vertically elongate rail and attached to an upright support post in supportive engagement with the floor. The connector arrangement includes a connector ring which clampingly engages the side walls of at least two adjacent support posts to interconnect two adjacent panel assemblies, for example in right-angled relation with one another.

17 Claims, 8 Drawing Sheets

CONNECTOR ARRANGEMENT FOR ADJACENT PANELS

CROSS-REFERENCE TO RELATED PATENT APPLICATION

This application is related to application Ser. No. 09/185,689 (hereinafter "the '689 application"), filed on Nov. 4, 1998, entitled "POST-PANEL CONNECTOR ARRANGEMENT". The disclosure of the '689 application is, in its entirety, incorporated by reference herein.

FIELD OF THE INVENTION

This invention relates to an upright space-dividing wall system formed from serially connected panel assemblies and, more specifically, to an improved connector arrangement employing ring-like connectors adapted to cooperate with an upright support member or post of each panel assembly for interconnecting adjacent panel assemblies to one another.

BACKGROUND OF THE INVENTION

Numerous panel systems have been developed for use in dividing large open office areas into smaller work spaces or workstations, which panel arrangements typically employ upright space-dividing panels which are serially joined together to define smaller workstations of desired size and configuration. In the known arrangements, the individual panel assemblies have many different structural features. For example, in some arrangements the individual panels are provided with individual support feet or glides which support the weight of the panel on the floor, and adjacent panels are then joined together through intermediate connectors, such as flexible hinges or connector plates, which connectors are not intended to be disposed in load-bearing relationship with the floor. In other arrangements, the adjacent panel assemblies are interconnected through intermediate upright support posts, which posts are typically maintained in load-bearing relationship with the floor, although sometimes the panels are provided with floor-engaging glides. Both panel-to-panel and post-panel arrangements are in common usage, and the present invention is concerned primarily with improvements in panel arrangements of the latter-mentioned type, although it is contemplated that the invention could be used in panel-to-panel systems if desired.

In many of the post-panel arrangements, the upright support post is provided with support hooks which engage with cooperating parts such as grooves on the adjacent panels, or vice versa, for providing operative structural and supportive connection of the panels to the support posts. In accordance with one such arrangement, as disclosed in U.S. Pat. No. 5,377,466 (owned by the Assignee hereof), support hooks and grooves are respectively provided along substantially the entire longitudinal extent of the support post and along the edge of the adjacent panel assembly. In this arrangement, when the panel assemblies are to be oriented in angled relationship relative to one another, a special corner connector is provided which interconnects the upright support posts to one another of the respective adjacent panel assemblies. The corner connector has a pair of vertically elongate side flanges or legs which are generally perpendicular to one another, each of which defines therein a plurality of slots arranged in a vertical row along the respective leg. These slots, along with other clamping structures, cooperate with corresponding hooks of the respective support posts to connect the corner connector thereto so as to arrange the adjacent panel assemblies in a right-angled relationship to one another. The above-described type of multiple-hook arrangement necessarily requires that the hooks and cooperating grooves or openings be precisely dimensioned in order to evenly distribute the load of the panel assembly on all of the hooks, and such dimensional relationship cannot be practically achieved.

Further, in many of the known post-panel arrangements, the connection between the posts of adjacent panel assemblies so as to define a corner has typically required one or more special corner connectors which typically are vertically elongate corner elements of substantial structural complexity. Also, the connection between the posts and the corner connector(s) frequently requires separate fasteners such as screws or the like, and this complicates the overall assembly.

Accordingly, it is an object of the invention to provide an improved space-dividing wall system, specifically an improved connector arrangement for a wall system of the type wherein panel assemblies at opposite vertical ends are joined to and preferably supported on load-bearing and post-like connecting members, which connector arrangement is desirable in that it is economical and simple to manufacture, has desirable structural characteristics, and facilitates assembly of the panel system.

More specifically, a preferred embodiment of the invention relates to an interior upright space-dividing wall system including a pair of portable upright panel assemblies each having an upright end edge defined at least in part by an elongate frame member which mounts thereon a vertically elongate support member (i.e. a support post) in supportive engagement with a floor. Each of the support members includes a first side wall defining therein a slot-like opening and a second side wall. A connector assembly is provided for interconnecting the adjacent support members so as to position the pair of panel assemblies adjacent one another. The connector assembly includes a rigid connector ring having first and second sides respectively positioned closely adjacent the second side walls of the respective support members. A pair of clamping members are mounted on the connector ring, and each clamping member engages within the slot-like opening of one of said first side walls of the respective support members to fixedly attach the connector ring to the support members. The connector ring is particularly desirable for creating a right angle corner between the adjacent panel assemblies.

Other objects and purposes of the invention will be apparent to persons familiar with arrangements of this general type upon reading the following specification and inspecting the accompanying drawings.

Figure 1:
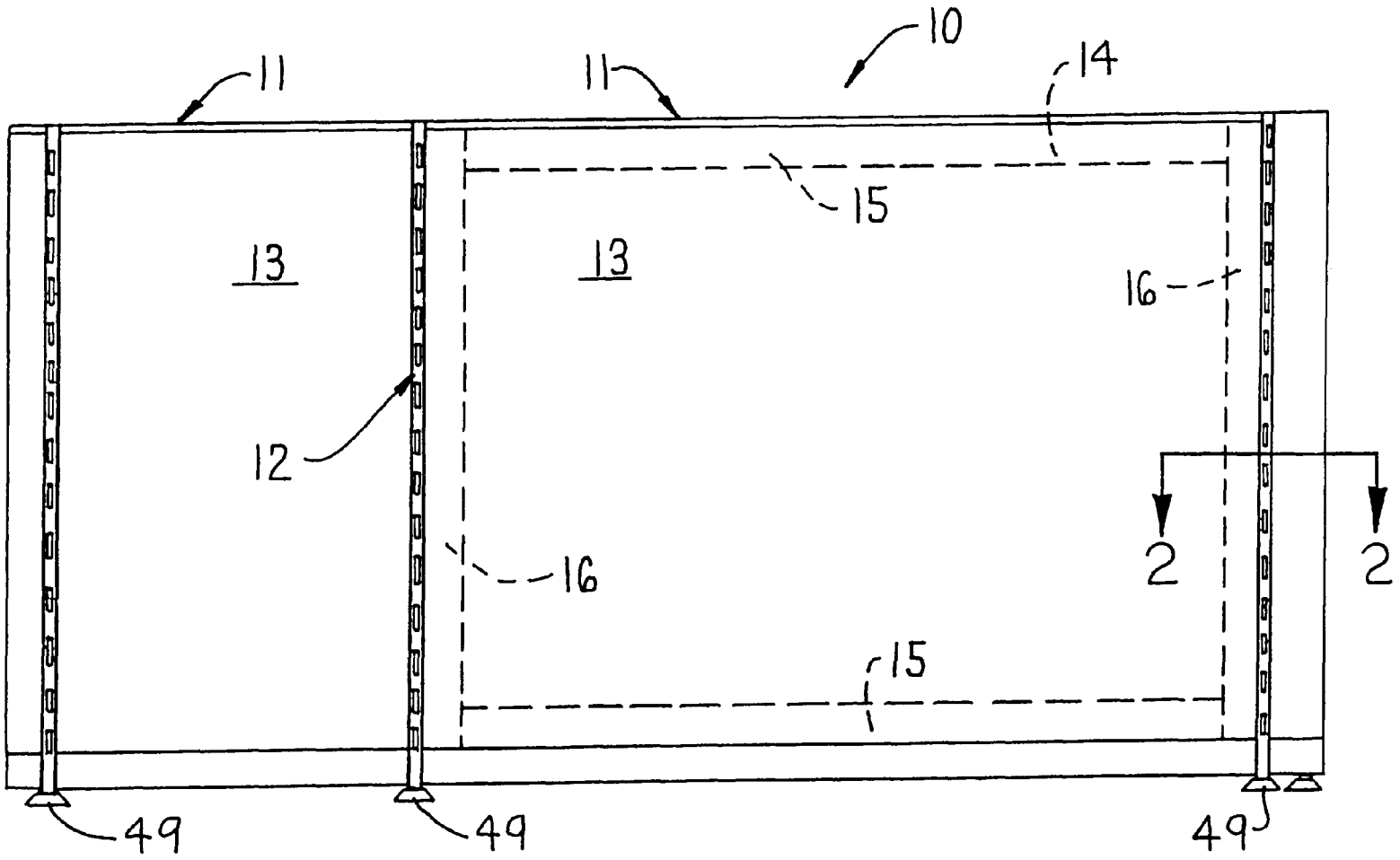
FIG. 1 is a side elevational view which illustrates several panel assemblies joined together to define at least part of an upright space-dividing wall system according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated an upright space-dividing wall system 10 according to the present invention, which system 10 is formed by a plurality of upright panel assemblies 11 which are joined together in a series arrangement to define individual workstations. The panel assemblies 11 are typically joined in either aligned (i.e. end-to-end) relationship, or in perpendicular relationship with end edges of two panel assemblies 11 being disposed closely adjacent to one another, such arrangements being conventional. The individual panel assemblies 11 typically have a height which is significantly less than floor-to-ceiling height, whereby the panel assemblies 11 are supported on and project upwardly from the floor, with upper edges of the panel assemblies 11 being spaced downwardly a significant distance from the ceiling. The sizes of such panel assemblies, in terms of widths and heights, are conventional.

In the space-dividing wall system 10 of the present invention, each pair of adjacent aligned panel assemblies 11 are connected together by an upright post-type connector arrangement 12, as discussed below.

Each panel assembly 11 includes a main upright panel member 13 having large width and height dimensions as compared to the thickness dimension thereof. The panel member 13 may be a one-piece panel or may alternatively be embodied by vertically stacked panels. The main panel member 13 includes a generally rectangular ring-like frame 14 defined by generally parallel and horizontally elongated top and bottom frame members or rails 15 which are rigidly joined together at opposite ends thereof by generally parallel and vertically elongated side frame members or rails 16. The side rails 16 are of a generally outwardly-opening channel-like configuration, and are substantially identical to those shown and described in the '689 application and therefore are only briefly discussed below.

Figure 2:
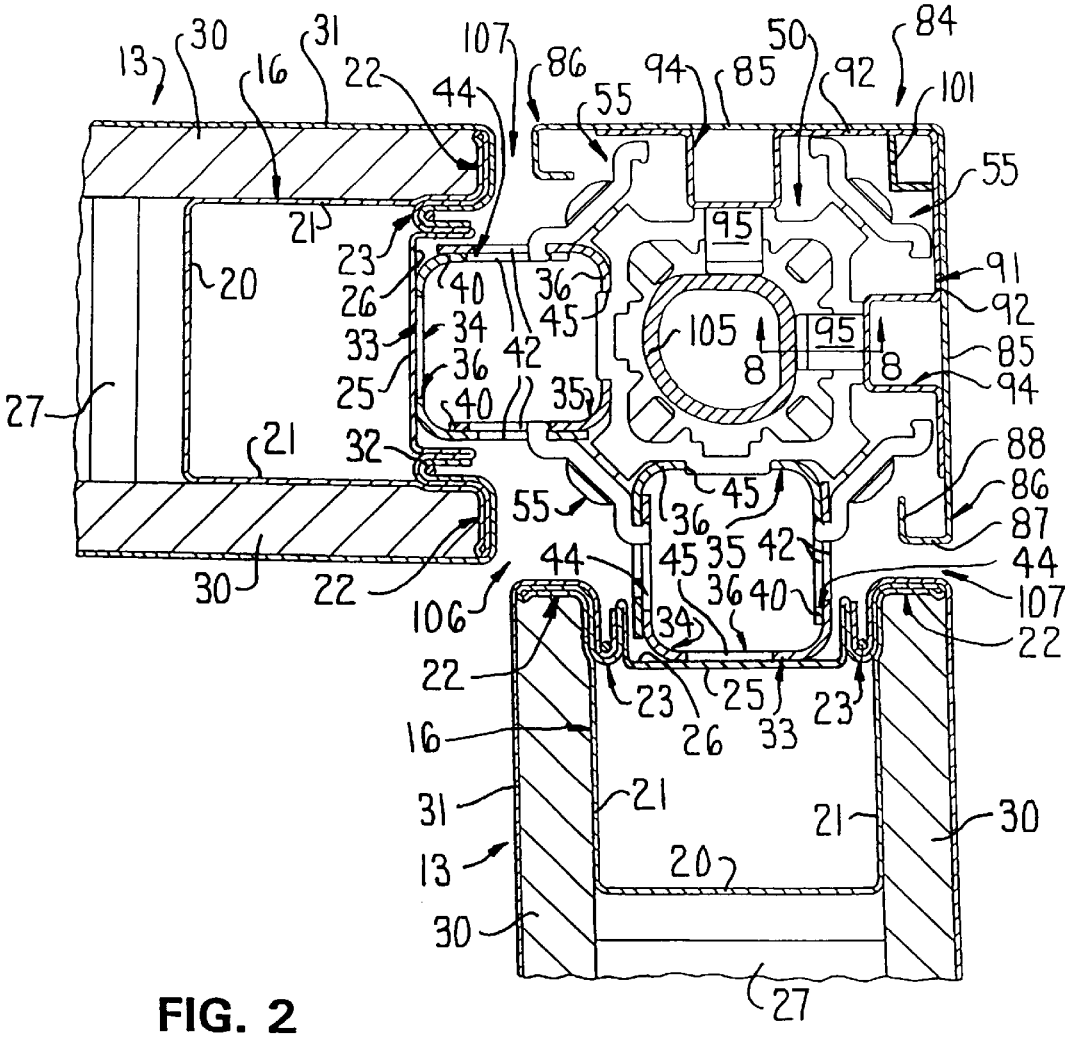
FIG. 2 is an enlarged, fragmentary cross-sectional view taken generally along line 2—2 in FIG. 1, and showing a right angle corner connection between two adjacent panel assemblies.

With reference to FIG. 2, each side rail 16 includes an inner wall 20 having fixed thereto a pair of generally parallel and outwardly projecting side walls 21. Each side wall 21, at an outermost edge thereof, includes a flange 22 which defines the end edge of the panel member 13. Each flange 22 is connected to a U-shaped part 23 spaced sidewardly and inwardly therefrom. U-shaped part 23 defines a groove therein and is joined to an outer wall 25 generally parallel to inner wall 20. The U-shaped part 23 and outer wall 25 together define an outwardly opening mouth or channel 26.

The ring-like frame 14, as defined by rails 15 and 16, surrounds and confines a core structure 27 which fills the interior of the frame 14. The frame 14 and core structure 27 are sandwiched between a pair of plate-like side members 30, for example mineral or fiber board, which cover substantially the entire opposite sides of the panel member 13. The side members 30 are secured to opposite side surfaces of the rails 15 and 16 (i.e. side walls 21) and core structure 27, with the edges of the side members 30 being confined within the rim defined by the flanges 22. The main panel member 13 is provided with exterior coverings, such as large sheets of flexible fabric 31 which cover the outer vertical side faces of the panel member 13. Edge portions of the fabric 31 are secured within the groove of U-shaped part 23 by a retaining element 32 to maintain the fabric sheet 31 in a taut condition. The construction of the panel member, as briefly described above, is known.

Figure 4:
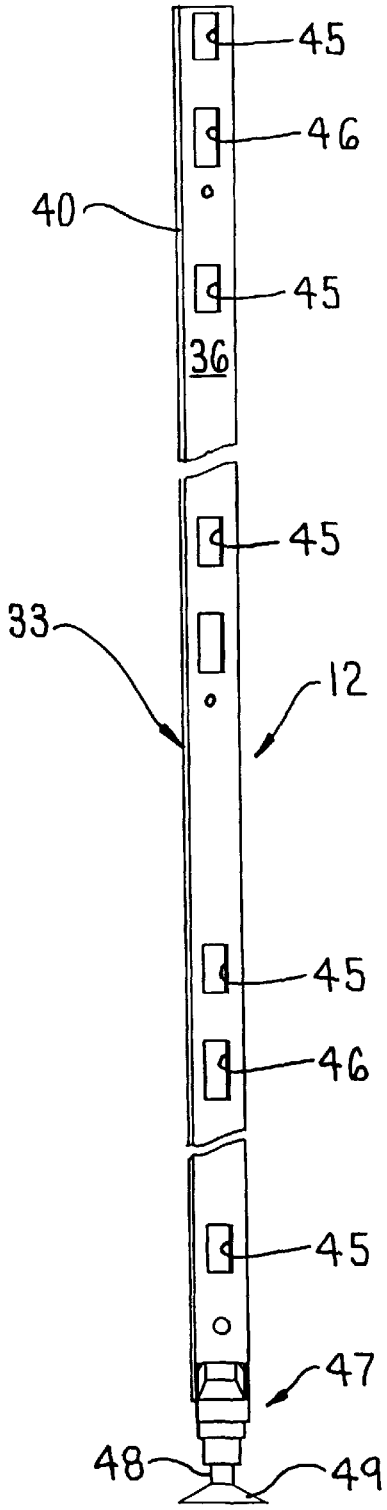
FIG. 4 is an enlarged, fragmentary side elevational view of the connector post rotated approximately 90° from the orientation thereof illustrated in FIG. 3.
Figure 3:
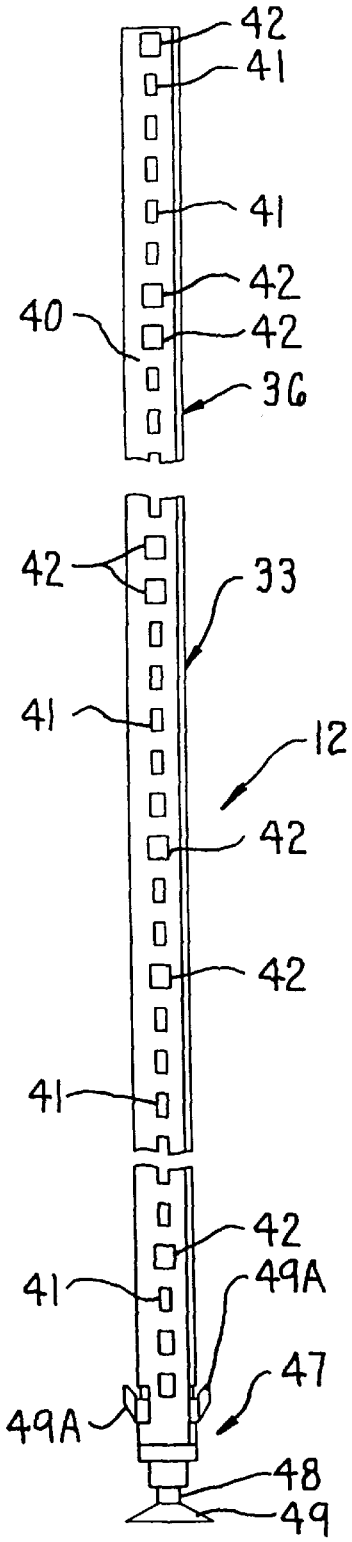
FIG. 3 is an enlarged, fragmentary side elevational view of a connector post.

Turning now the connector post arrangement 12, and referring to FIGS. 2–4, this arrangement 12 includes a vertically elongate and generally tubular connector post 33 which can be utilized to interconnect the side rails 16 of two adjacent panel members 13 as discussed in detail in the '689 application. The connector post 33 in the illustrated embodiment includes a pair of vertically elongate and generally U-shaped members 34 and 35 each having a base portion 36 and a pair of parallel legs 40 extending outwardly and generally perpendicularly from the respective base portions 36. Each leg 40 preferably includes a plurality of vertically elongate, slot-like openings 41 and 42, which openings 41 and 42 are spaced along substantially the entire vertical extent of post 33 along the opposite side faces thereof. As shown in FIG. 3, the slot-like openings 42 have a similar vertical height as openings 41, but have a slightly greater horizontal width as compared to openings 41. One of these enlarged openings 42 is located adjacent the top and bottom of the post 33, and additional openings 42 are located at intermediate locations therealong for a purpose as discussed below.

The U-shaped members 34 and 35 are arranged so that the legs 40 of each member 34 and 35 substantially overlap and lie against one another in superimposed relation whereby the openings 41 and 42 of the respective legs 40 align with one another (i.e. the openings 41 of member 34 align with the openings 41 of member 35 and the enlarged openings 42 of member 34 align with the enlarged openings 42 of member 35) and together define common access slots which provide access into the interior of the connector post 33. The U-shaped members 34 and 35 are fixedly attached to one another, for example, by welding. The connector post 33 may alternatively be formed from a one-piece tubular component.

As shown in FIG. 2, the enlarged openings 42 of each U-shaped member 34 and 35 differ slightly in size as compared to one another. That is, the enlarged openings 42 of one leg 40 of the respective U-shaped member are slightly wider than the enlarged openings 42 of the opposite leg 40 thereof, so that when the U-shaped members 34 and 35 are attached to one another, the largest of the openings 42 is oriented innermost and a shoulder 44 is defined at each side of the common access slot.

The connector post 33 also includes a plurality of vertically elongate openings 45 and 46 which extend through base portion 36 of each U-shaped member 34 and 35 in a vertical row along post 33. As shown in FIG. 4, openings 46 have a vertical height which is slightly greater than the vertical height of openings 45. Further, openings 45 are located adjacent the top and bottom ends of the post 33, and at several locations therebetween.

As shown in FIGS. 3 and 4, the post 33 has a lower end or foot 47 which receives therein a support post or rod 48, the latter having its lower end fixed to an enlarged glide 49 adapted for direct supportive engagement with the floor. A pair of connector hooks 49A project outwardly and upwardly from opposite sides of the post 33.

When the panel members 13 are to be disposed in an aligned end-to-end series relationship with one another, the side rails 16 of the respective panel members 13 are fixed to opposite sides of an upright connector post 33 via panel locks (not shown) which are carried on the panel member adjacent the upper corners thereof and which cooperate with the openings 45 and 46, and the connector hooks 49A of post 33. This connection of the panel members 13 to the connector post 33 is disclosed in the '689 application and will therefore not be discussed in detail herein.

When the adjacent ends of two panel members 13 are to be connected together with the panel members 13 disposed in angled (i.e. a corner) relationship to one another, and specifically a perpendicular relationship such as illustrated in FIG. 2, then each panel member 13 has a connector post 33 attached to the respective side rail 16 via a panel lock (not shown) and the connector hook 49A as mentioned above, and the adjacent connector posts 33 in turn are connected through one or more (preferably at least two) connector ring assemblies 50.

Figure 5:
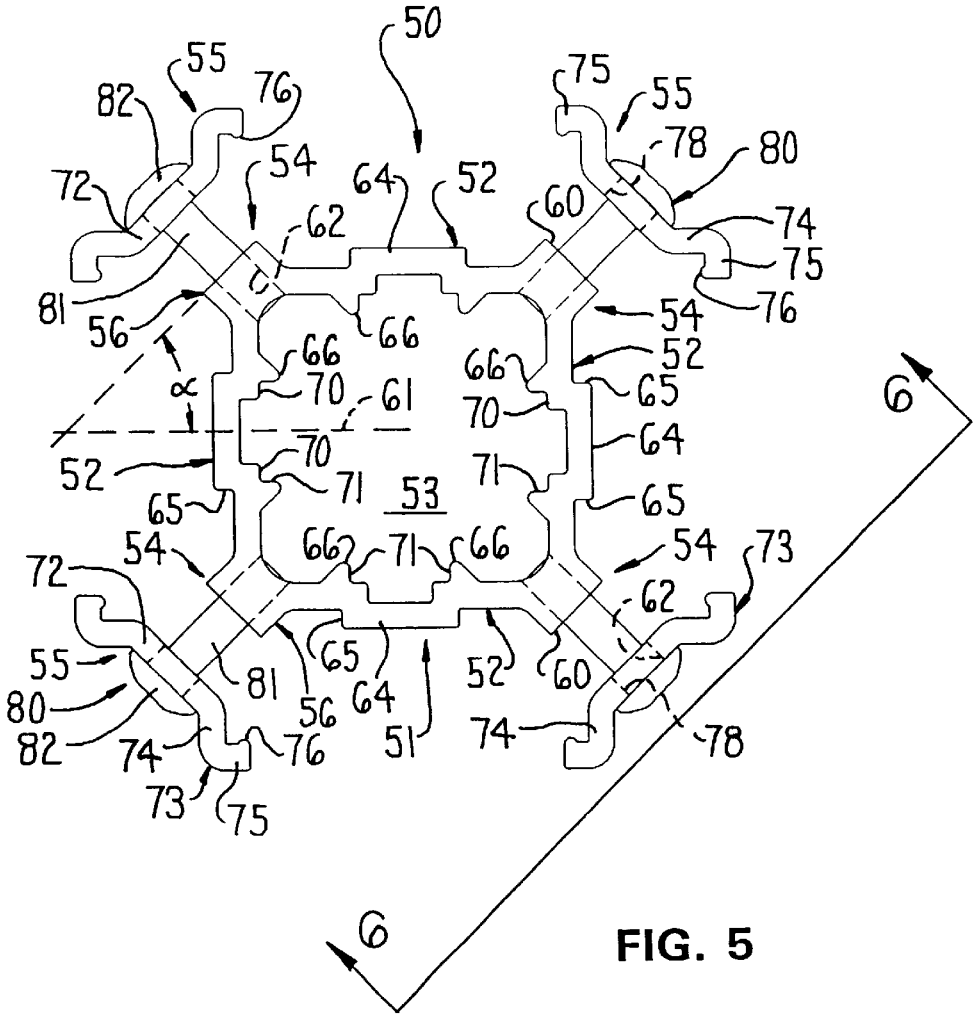
FIG. 5 is an enlarged plan view of a connector ring assembly.
Figure 6:
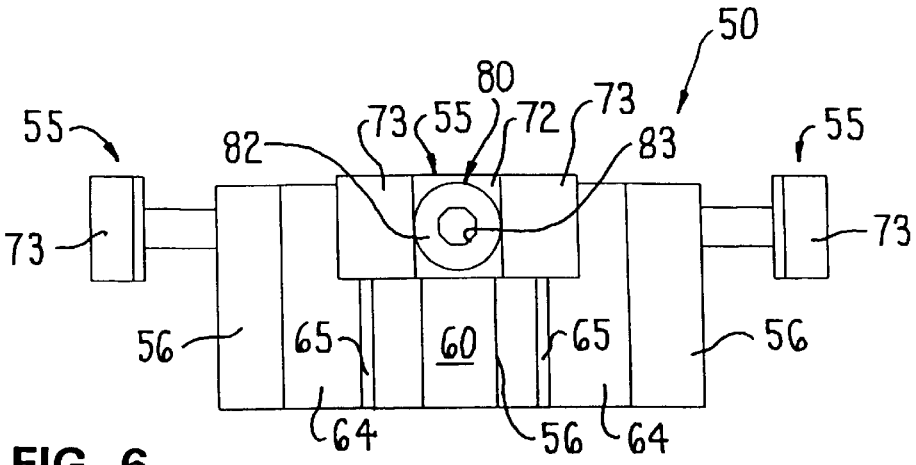
FIG. 6 is an enlarged side elevational view of the connector ring assembly taken generally along line 6—6 in FIG. 5.

Referring to FIGS. 5 and 6, the connector ring assembly 50 is embodied by a generally square-shaped corner connector ring 51 having four side walls 52 arranged in a generally square configuration to define a hollow open-ended interior 53. The corner connector ring 51, at each of its corner portions 54, mounts thereon a clamp plate 55.

Figure 11:
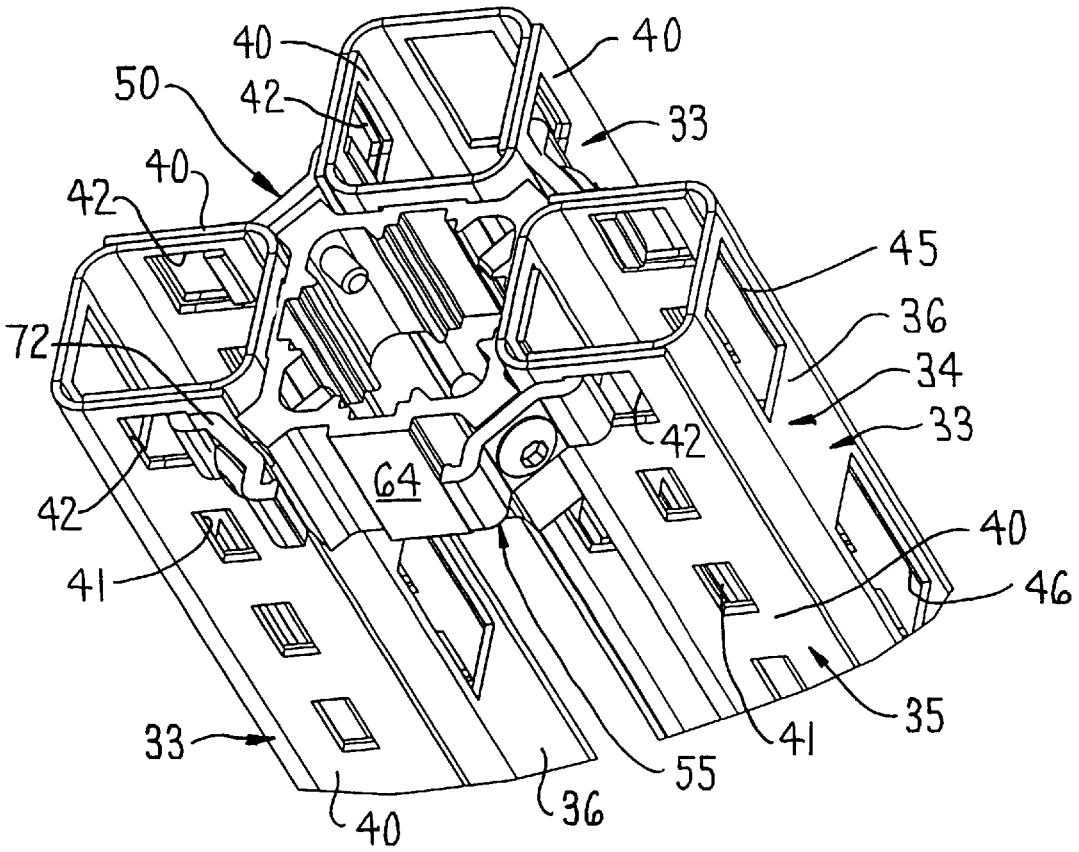
FIG. 11 is an enlarged, fragmentary detailed view of the upper end of the joined connector posts illustrated in FIG. 10.

The connector ring 51 has a mounting neck 56 which defines the respective corner portion 54. The mounting neck 56 projects outwardly from the interior 53 of the ring 51 and defines an outer end surface 60 which defines an angle a with a center line 61 which generally bisects the ring 51. In the illustrated embodiment, angle $\alpha$ has a value of about 45° . A threaded hole 62 extends centrally through mounting neck 56 and opens outwardly at surface 60 and inwardly into interior 53. Threaded hole 62 is generally perpendicular to outer surface 60. Each side wall 52 extends between respective adjacent pairs of mounting necks 56, and at an intermediate location therealong, defines an outwardly projecting and generally rectangular alignment member or block 64 (FIGS. 2 and 11). Alignment member 64 extends along substantially the entire vertical extent of ring 51 and defines thereon a pair of vertically extending outer shoulders 65 which are generally parallel with one another. Both the vertical height and the horizontal width of alignment member 64 are similar to, but slightly smaller than the respective vertical height and horizontal width of openings 45 of connector post 33.

The side walls 52 each include a pair of vertically extending and horizontally spaced-apart ribs or projections 66 which respectively extend inwardly into interior 53 from a pair of flat and vertically extending inner surface portions 70 formed opposite alignment member 64 of the respective side wall 52. Ribs 66 each have an inwardly facing surface 71 perpendicular to the respective surface 70 and therewith defines a corner configuration which extends vertically along the inner portion of ring 51. The ribs 66, in the illustrated embodiment, are disposed at approximately equal distances from the respective adjacent mounting neck 56.

The clamp plates 54, as shown in FIGS. 5 and 11, each include a generally flat base portion 72, the opposite ends of which mount thereon a connector flange 73. The connector flange 73 has a first leg part 74 which projects outwardly from the respective base portion 72 and defines therewith angle $\alpha$, and a second leg part 75 which is connected to an outer end of the respective leg part 74 and generally perpendicular thereto. The outer free end of leg part 75 has thereon an inwardly projecting raised rib 76. As shown in dotted lines in FIG. 5, base portion 72 defines therein a through opening 78 for receiving a fastener 80. Fastener 80 is embodied by a threaded stem portion 81 engaged within threaded opening 62 and having an enlarged head 82 fixed to the outer end thereof. Enlarged head 82 in the illustrated embodiment has an octagonal recess 83 therein configured for use with an Allen wrench. Fastener 80 is presented herein only by way of example, and other types of fasteners may be utilized.

When two panel members 13 are to be joined in right angled relationship to define a corner as shown in FIG. 2, then there is provided a vertically elongate corner cover 84. The corner cover 84 (FIGS. 2 and 7) is defined by a pair of side legs 85 which extend in generally perpendicular relationship to provide cover 84 with an L-shaped cross-sectional configuration with the legs 85 being substantially coplanar with the exterior side surfaces of the adjacent interconnected panel members 11. Each of these legs 85 has, adjacent the free vertical edge thereof, a U-shaped end part 86 defined by an outer leg 87 which is generally parallel to the adjacent flange 22 of the respective side rail 16, and an inner leg 88 connected to leg 87 and generally perpendicular thereto.

Figure 8:
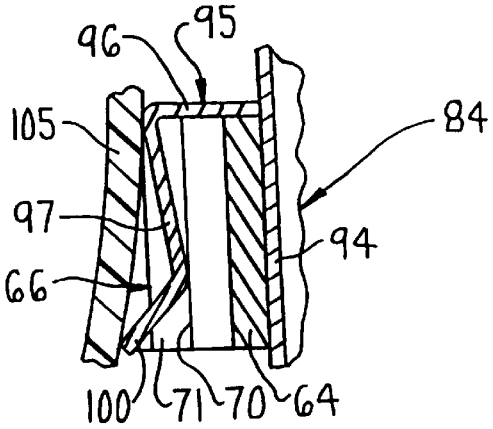
FIG. 8 is an enlarged cross-sectional view taken generally along line 8—8 in FIG. 2.
Figure 7:
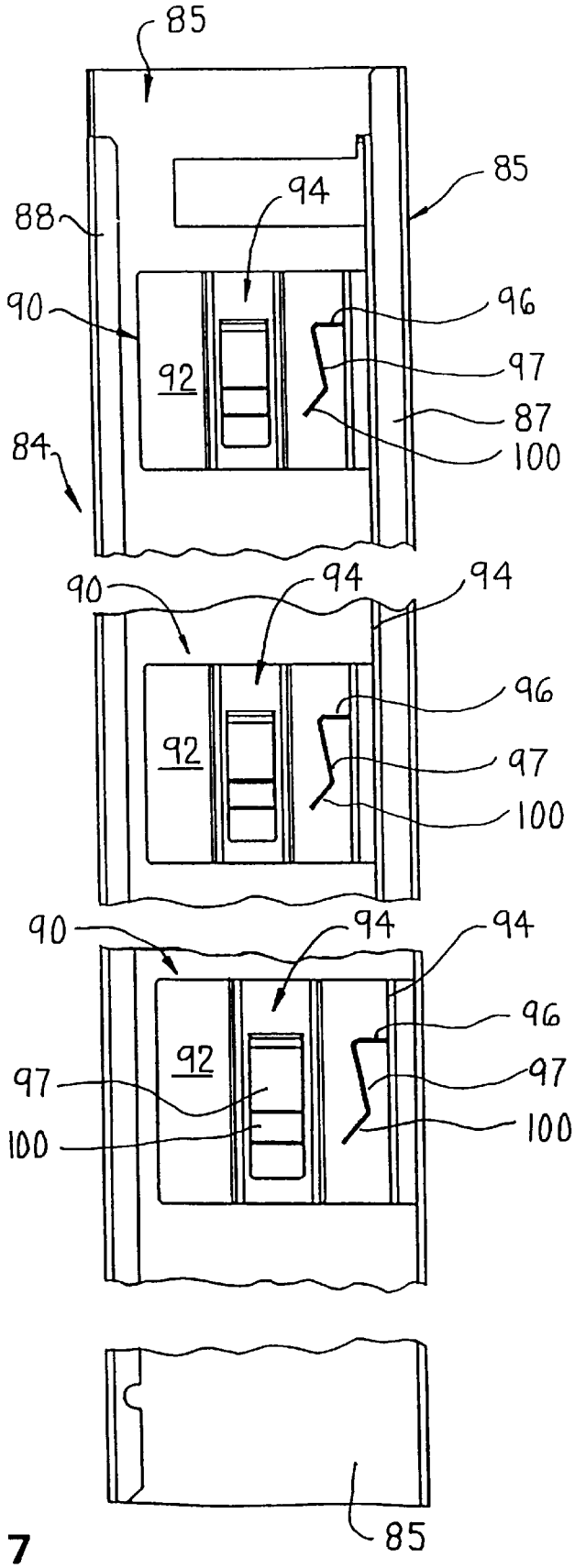
FIG. 7 is an enlarged, fragmentary side elevational view of a corner cover.

Referring to FIGS. 2 and 7, the respective side legs 85 mount thereon at least one clip assembly 90. The clip assembly 90 includes a corner bracket 91 having a pair of perpendicular side walls 92 which are fixed to an inner surface of the respective side legs 85 of cover 84. The bracket 91, at central portions along each leg 85, has a U-shaped mounting portion 94 which projects inwardly relative to the remaining portions of bracket 91. Each U-shaped mounting portion 94 has fixed to an innermost surface thereof a resilient clip 95 having an upper leg 96 (FIG. 7) which projects generally horizontally and a lower leg 97 which is cantilevered generally downwardly from an inner end of upper leg 96. Lower leg 97 in the illustrated embodiment angles inwardly as it projects downwardly, and at the lowermost end thereof is bent outwardly to define a flange 100 (FIG. 8).

As shown in FIG. 2, for added rigidity, the illustrated embodiment also includes an L-shaped support bracket 101 fixed to inner surfaces of bracket 91 which define the interior corner thereof.

The assembly of the wall system 10, and the structural and functional cooperation of the individual panel assemblies 11, connector posts 33 and connector ring assemblies 50 will now be briefly described to ensure a complete understanding of the invention. The panel members 13 are typically assembled in the factory and therefore will not be discussed here. In addition, to secure two or more panel members 13 in a horizontally aligned series relationship such as is depicted in FIG. 1, the side rails 16 of each panel member 13 are secured to opposite sides of a connector post 33 utilizing a panel lock (not shown) which cooperates with both upper and lower openings 45 and 46 of post 33 as discussed in detail in the '689 application.

When two panel assemblies 11 are to be disposed in adjacent but right-angled relationship to define a corner as illustrated in FIG. 2, then the side rail 16 associated with each panel assembly 11 is provided with a connector post arrangement 12 fixedly secured thereto via panel locks as discussed in the '689 application, and the two panel members 13 and the respective connector posts 33 are then disposed in closely adjacent, but right angled relationship. With reference to FIG. 2, a connector ring assembly 50 (with the threaded fasteners 55 positioned outwardly of the ring 51 as shown in FIG. 5) is positioned between the adjacent posts 33 and the rectangular alignment members or blocks 64 on two adjacent side walls 52 of ring 51 are simultaneously inserted into the corresponding openings 45 of the respective adjacent posts 33. The engagement of the alignment members 64 within the respective openings 45 horizontally and vertically aligns ring 51 relative to posts 33. Thereafter, the fasteners 55 are tightened (for example, with an Allen wrench) so as to move each clamp plate 55 toward the respective angled end surface 60 until the leg part 75 is inserted into slot 42 of the respective post 33 and the rib 76 of leg part 75 engages the shoulder 44 and effectively clamps the connector ring 51 to the respective post 33.

In a corner arrangement of two panel members 13 as illustrated in FIG. 2, only three of the clamp plates 55 are utilized, and only one of the pair of flanges 73 on the two outer clamp plates 55 are utilized to connect the ring 51 to the respective post 33, whereas both flanges 73 of the innermost clamp plate 55 are utilized to directly connect the respective posts 33 to one another.

It will be appreciated that one or more connector ring assemblies 50 may be utilized depending upon the size of the particular panel members 13 to be joined to one another. For example, if full size panel members 13 are to be joined, such as panel members 13 having a vertical height of 74 or 80 inches, at least two and preferably three connector ring assemblies 50 are typically mounted to the adjacent connector posts 33 in a vertically spaced apart manner utilizing the various enlarged slots 42 and openings 45 as provided in the adjacent but perpendicular side walls of the posts 33. That is, three connector ring assemblies 50 are respectively positioned adjacent the top, middle and bottom portions of the respective posts 33. For smaller size panel members 13, for example panel members 13 having a vertical height of 48 inches or 32 inches, a pair of vertically-spaced connector ring assemblies 50 may be sufficient.

To provide the corner arrangement depicted in FIG. 2 with a finished appearance, the corner cover 84 is hooked onto the connector rings 51 by positioning same above the upper surface of the respective ring 51 so that the lower leg 97 of each of the clips 95 is vertically aligned between the ribs 66 of the connector ring 51. The cover 84 is thereafter lowered so that the lower leg 97 slides down into the interior of the ring 51 as guided by the ribs 66 until the upper leg 96 of the respective clip 95 rests upon the uppermost surface of the ring 51 and the inner surface of the U-shaped mounting part 94 abuts the respective alignment member 64. The clips 95 of the corner cover 84 are constructed of a rigid yet partially flexible material, such as a thin metal, so that the lower leg 97 thereof in the installed position of the corner cover 84 is resiliently displaced slightly outwardly (i.e. away from the respective U-shaped mounting part 94) from its normal inwardly-biased position (FIG. 7) by the inner surfaces 70 of ring 51 as shown in FIG. 8, so as to firmly clamp the cover 84 to the respective rings 51.

As shown in FIG. 2, once the connector ring assemblies 50 are assembled and the adjacent panel members 13 are arranged in a generally perpendicular relationship, an elongate tube 105 of semi-rigid but flexible material, such as plastic, may be inserted downwardly so as to extend through the hollow interiors 53 of the respective rings 51 so as to block out light and thus create a more aesthetic appearance of the assembled corner.

Once assembled to the respective connector posts 33, the connector ring assemblies 50 according to the invention position the respective posts 33 so that the vertical end edges of the respective panel members 13 are separated from one another by a small vertically extending clearance gap or slot 106, as illustrated in FIG. 2. Further, the corner cover 84 is sized such that the legs 87 thereof are spaced a small distance from the respective vertical panel edge to also define a small vertically extending clearance gap 107 therebetween. These clearance gaps 106 and 107 are directly aligned with the vertical slots 41 of the respective posts 33 so that conventional hangers associated with furniture components or accessories such as cabinets or the like can be positioned adjacent the side surface of the panel member 13 with the hangers of the accessory projecting through the clearance gaps 106, 107 for engagement within the slots 41. Further, the common slots defined by the enlarged vertical slots 42 are of a size such that, even with a flange 73 of a clamp plate 54 mounted therein, these common slots are accessible and may be utilized for mounting an accessory. As shown in FIG. 2, the innermost clearance gap 106 is of a size which will also permit access to the adjacent fastener 55 to allow manipulation thereof.

The connector rings 51 and clamp plates 54 according to the invention are constructed of extruded aluminum in the illustrated embodiment, and the corner cover 84 may be constructed of metal such as steel, but other suitable materials can be utilized.

Figure 9:
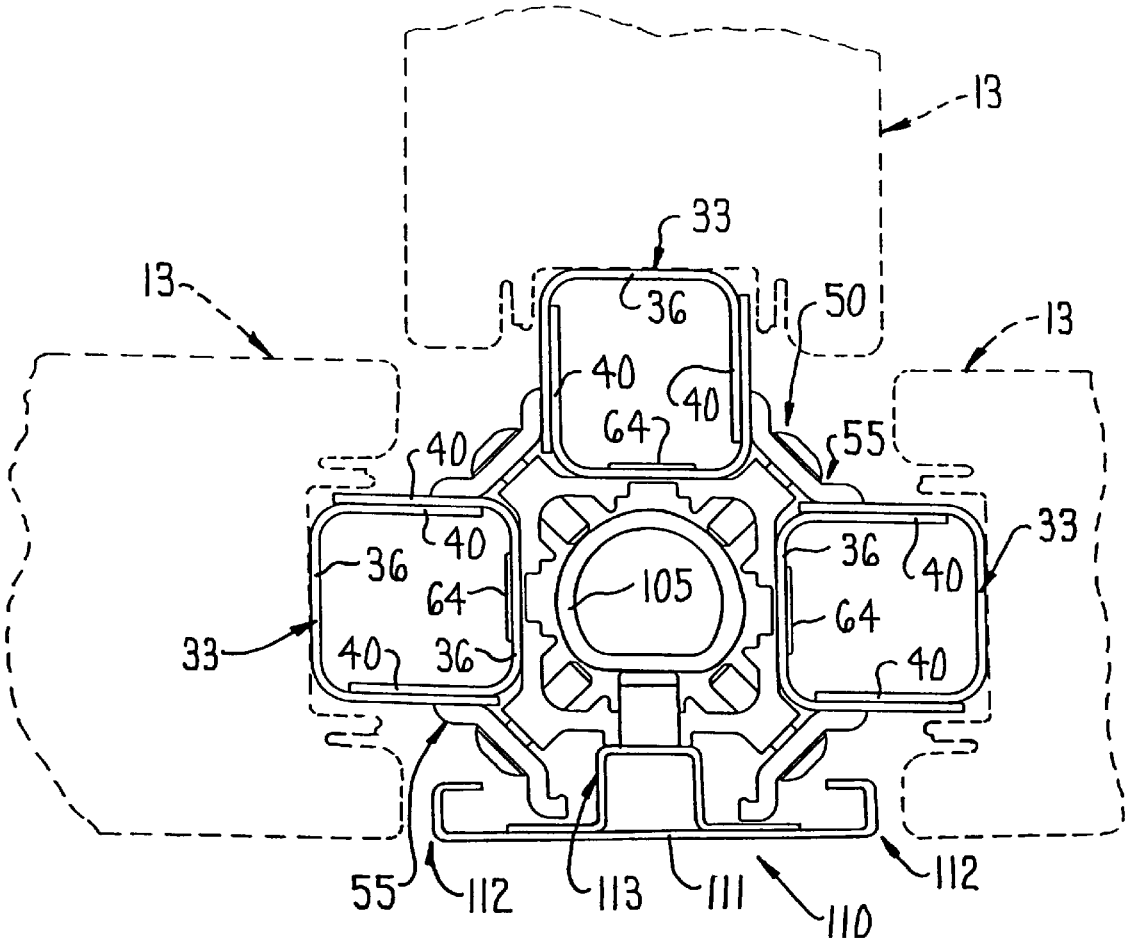
FIG. 9 is a plan view similar to FIG. 2 but illustrating a three-panel assembly connection.

FIG. 9 illustrates three panel members 13 (the vertical edges of which are shown in dotted lines) joined in a generally T-shaped configuration. The T-shaped configuration depicted in FIG. 9 is achieved by assembling the connector ring assemblies 50 to the three adjacent connector posts 33 in a manner similar to that described above with regard to a right-angle panel configuration and will not be discussed in detail here. The gap between the adjacent aligned panel members 13 (which panel members 13 are spaced-apart by the width of the perpendicularly extending third panel) is closed by a vertically elongate and generally flat cover 110 generally similar to corner cover 84. Cover 110 has a flat base wall 111 which aligns with the outer surfaces of the adjacent aligned panel members 13. This base wall 111 has U-shaped end parts 112 identical to end parts 86 of corner cover 84 and one or more clip assemblies 113 are spaced vertically from one another along cover 110. The clip assembly 113 of cover 110 is similar to the clip assembly 90 of corner cover 84 and mounts on the respective connector rings 51 in a manner similar to that discussed above. As with the corner cover 84, the U-shaped end parts 112 are spaced away from the vertical edge of the adjacent panel members 13 so as to provide access to the accessory slots 41 and 42 (not shown in FIG. 9).

Figure 10:
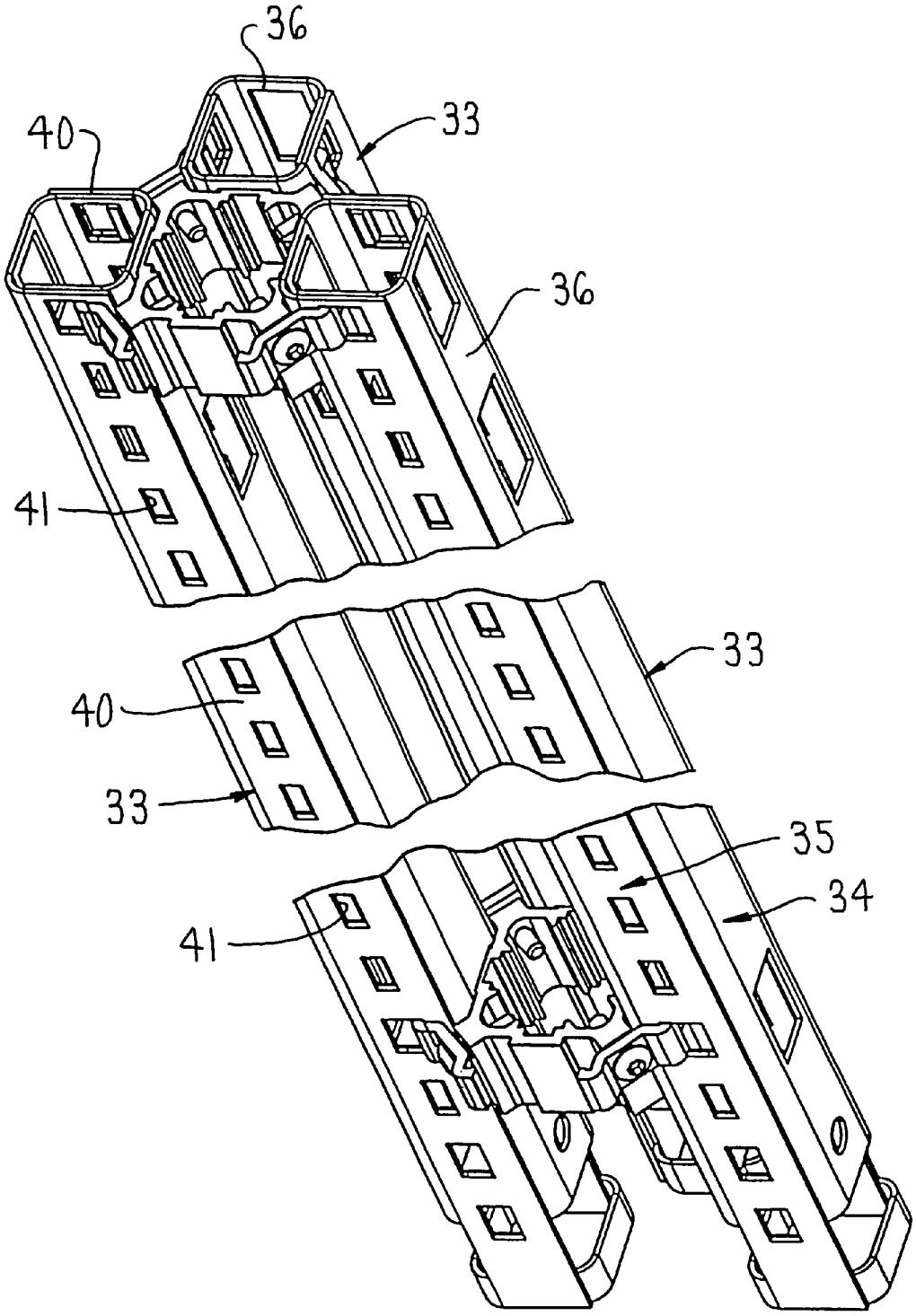
FIG. 10 is an enlarged fragmentary perspective view illustrating the three connector posts and the associated connector rings adjoining the posts in a T-shaped configuration.

FIGS. 10 and 11 illustrate three connector posts 33 (without the associated panel assemblies 11 attached thereto) connected to one another so as to form a T-configuration.

It will be appreciated that, although not shown herein, the connector ring assemblies 50 may be utilized to connect four panel members 13 in a generally criss-cross configuration by utilizing all four clamp plates 55 and alignment blocks 64 of the ring assemblies 50.

It will also be appreciated that although the connector ring assembly 50 according to the invention is depicted herein as interconnecting two or three adjacent panel members 13 in angled relationship with one another, the connector ring assemblies 50 may also be utilized to interconnect a pair of connector posts 33 which are attached to respective side rails 16 of two adjacent panel members 13 in horizontally aligned series relationship with one another. In accordance with this arrangement, the posts 33 engage opposed sides of the connector rings 51, and a pair of covers 110 are attached to the remaining opposed sides of the respective connector rings 51 to close the gap between the vertical panel edges defined by flanges 22.

Although a particular preferred embodiment of the invention has been disclosed in detail for illustrative purposes, it will be recognized that variations or modifications of the disclosed apparatus, including the configuration and rearrangement of parts, lie within the scope of the present invention.

What is claimed is:

1. An interior upright space-dividing wall system comprising:

first and second portable upright panel assemblies respectively having first and second upright end edges respectively mounting thereon vertically elongate first and second connector posts positioned closely adjacent one another, each said connector post including a pair of generally parallel first side walls, which face toward opposite sides of the respective panel assembly, at least one said first side wall of each said connector post defining therein a slot-like opening, and each said connector post having a pair of generally parallel and oppositely facing second side walls, said second side walls being alternately interposed between said first side walls and disposed in angled relation relative thereto, one said second side wall of each said connector post facing generally in an endwise direction of the respective panel assembly;

a connector assembly for fixedly interconnecting said first and second connector posts so as to position said first and second panel assemblies in a generally right-angled relationship with respect to one another, said connector assembly including a connector ring having first and second sides respectively positioned closely adjacent said one second side wall of the respective first and second connector posts, and a clamping member movably mounted on said connector ring, said clamping member having first and second free ends engaged within said slot-like openings of the respective first and second connector posts to fixedly attach said connector ring to said connector posts.

2. The wall system of claim 1 wherein said one second side wall of the respective first and second connector posts defines therein an opening, said first and second sides of said connector ring each including an outwardly projecting block-like member which extends into said opening of said one second side wall of the respective connector posts to horizontally and vertically align said connector ring relative to the respective connector posts.

3. The wall system of claim 2 wherein said connector ring includes four upright walls, adjacent pairs of said walls being disposed in a generally right-angled relationship with one another to provide said connector ring with a generally square-shaped configuration, a first and a second of said walls respectively defining thereon said first and second sides of said connector ring, and said clamping member being mounted on said connector ring at a corner portion thereof defined at an intersection of said first and second walls.

4. The wall system of claim 1 further including a vertically elongate cover having first and second generally perpendicular side legs which respectively mount thereon a clip member, said clip members projecting inwardly from inner surfaces of said side legs and engaging with third and fourth sides of said connector ring which are spaced from and opposite the respective first and second sides, and said side legs each defining an outer surface which is horizontally aligned with an outer side of one of the respective panel assemblies.

5. The wall system of claim 1 wherein said connector ring includes a plurality of walls, a first and a second of said walls being disposed in angled relationship with one another and respectively defining thereon said first and second sides of said connector ring, said connector ring further including a mounting part which projects outwardly from a corner portion of said connector ring defined at an intersection of said first and second walls, said clamping member being mounted on said mounting part via a threaded fastener which extends into a threaded hole defined in said mounting part, said threaded fastener being tightenable so as to clampingly engage said first and second free ends within said slot-like openings.

6. The wall system of claim 5 wherein said first and second walls of said connector ring are generally perpendicular to one another and said mounting part projects generally diagonally outwardly from said corner portion.

7. The wall system of claim 1 wherein a plurality of said connector assemblies are provided in a vertically spaced-apart manner along the vertical extent of the respective connector posts.

8. The wall system of claim 1 wherein the other said first side wall of each said connector post defines therein a said slot-like opening, said clamping member is a first clamping member and said connector assembly further includes two additional said clamping members movably mounted on said connector ring and horizontally spaced from said first clamping member, and one of said first and second free ends of each said additional clamping member engaging within the slot-like opening of the respective other said first side wall.

9. An interior upright space-dividing wall system comprising:

a pair of upright panel assemblies having respective upright end edges, each said upright end edge mounting thereon a vertically elongate and generally upright support member having a lower end in supportive engagement with a floor, each said support member defining a slot-like opening therein; and a connector assembly for rigidly interconnecting said support members so as to interconnect said panel assemblies in angled relation with one another, said connector assembly including a rigid connector ring interposed between said support members and a clamp adjustably mounted on said connector ring, said clamp defining a pair of mounting flanges which project outwardly from said connector ring, said clamp extending between the respective said support members with each said mounting flange thereof being releasably engaged within a said slot-like opening of a respective said support member to fixedly attach said connector ring to said support members.

10. The wall system of claim 9 wherein said mounting flanges define respective free ends of said clamp which are disposed on opposite sides of a base portion thereof, said base portion being mounted on said connector ring by a threaded fastener which extends into a threaded hole defined within said connector ring.

11. The wall system of claim 10 wherein said support members each include transversely oriented first and second side walls, each said first side wall defining a said slot-like opening therein, said second side walls of the respective support members each defining therein an opening, said connector ring having first and second sides respectively positioned closely adjacent said second side walls of the respective said support members, each said first and second side of said connector ring defining a projection which extends into said opening of said second side wall of the respective said support member to horizontally and vertically align said connector ring relative to said support members.

12. The wall system of claim 11 further including a vertically elongate, corner-shaped cover defined by first and second generally perpendicular side legs which respectively mount thereon a clip member, said clip members projecting inwardly from inner surfaces of said side legs and engaging with third and fourth sides of said connector ring which are spaced from and opposite the respective first and second sides thereof, and said side legs each defining an outer surface which is horizontally aligned with an outer side of one of the respective panel assemblies.

13. The wall system of claim 11 wherein said first side walls of the respective support posts are disposed in perpendicular relation with one another and said clamp extends diagonally between said first side walls.

14. The wall system of claim 9 wherein a plurality of said connector assemblies are provided in a vertically spaced-apart manner along the vertical extent of the respective support members.

15. The wall system of claim 9 wherein each said support member includes adjacent first and second side walls disposed in angled relation with one another, each said first side wall defining a said slot-like opening therein, said connector ring including a plurality of upright walls, a first and a second of said walls being disposed in angled relationship with one another and respectively defining thereon first and second sides of said connector ring respectively positioned closely adjacent said second side walls of the respective support members, said connector ring further including a mounting part which projects outwardly from a corner portion of said connector ring defined at an intersection of said first and second walls, said clamp being mounted on said mounting part by a threaded fastener which extends into a threaded hole defined in said mounting part, said threaded fastener being tightenable so as to clampingly engage said mounting flanges within said slot-like openings.

16. The wall system of claim 9 wherein said support members each include a pair of generally parallel first side walls which face towards opposite sides of the respective panel assembly, each said first side wall defining therein a said slot-like opening, and each said support member having a pair of generally parallel second side walls alternately interposed between said first side walls and extending transversely therebetween, one said second side wall of each said connector post facing generally in an endwise direction of the respective panel assembly and the other said second side wall being superimposed upon the upright end edge of the respective panel assembly, said connector ring having a generally rectangular configuration defined by four upright walls with adjacent first and second ones of said walls being respectively superimposed upon said one second side walls of the respective support members.

17. The wall system of claim 16 wherein said clamp is a first clamp mounted on said connector ring at one corner thereof defined at the intersection of said first and second walls, said connector assembly including second, third and fourth additional said clamps each mounted on a respective corner of said connector ring, said second and third clamps being disposed adjacent said first clamp on opposite sides thereof and each having one said mounting flange engaged within a said slot-like opening of an adjacent said first side wall of the respective said support member, support members of additional said panel assemblies being respectively mountable between said second and fourth clamps and said third and fourth clamps to selectively define one of: a T-shaped panel configuration including three said panel assemblies and a criss-cross configuration including four said panel assemblies.

* * * * *